US009919584B2

(12) United States Patent
Lee

(10) Patent No.: US 9,919,584 B2
(45) Date of Patent: Mar. 20, 2018

(54) EVAPORATOR

(71) Applicant: Hanon Systems, Daejeon-si (KR)

(72) Inventor: Duck-Ho Lee, Daejeon-si (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 14/916,237

(22) PCT Filed: Aug. 27, 2015

(86) PCT No.: PCT/KR2015/008989
§ 371 (c)(1),
(2) Date: Mar. 3, 2016

(87) PCT Pub. No.: WO2016/032255
PCT Pub. Date: Mar. 3, 2016

(65) Prior Publication Data

US 2017/0158027 A1 Jun. 8, 2017

(30) Foreign Application Priority Data

Aug. 29, 2014 (KR) ..... 10-2014-0114298
Aug. 27, 2015 (KR) ..... 10-2015-0120913

(51) Int. Cl.
*B60H 1/32* (2006.01)
*F28F 9/02* (2006.01)
*F28D 1/053* (2006.01)

(52) U.S. Cl.
CPC ..... *B60H 1/3227* (2013.01); *F28D 1/05391* (2013.01); *F28F 9/0204* (2013.01); *F28F 2009/0297* (2013.01)

(58) Field of Classification Search
CPC ..... B60H 1/3227; B60H 1/32; F28D 1/05391; F28D 1/053; F28D 2021/0085; F28D 2021/0071; F28F 9/0204; F28F 2009/0297; F28F 9/02; F28F 9/0278; F28F 9/0224; F28F 1/128; F28F 17/005; F28F 9/0207; F28F 9/028; F28F 9/0246; F28F 9/26; F28F 1/022; F28B 39/022; F25B 39/028

(Continued)

(56) References Cited

U.S. PATENT DOCUMENTS

2003/0188857 A1* 10/2003 Kawakubo ..... F28D 1/0476 165/174
2003/0221819 A1* 12/2003 Jang ..... F28D 1/05391 165/173

(Continued)

FOREIGN PATENT DOCUMENTS

CN 101910775 A 12/2010
JP 2014513265 A 5/2014

(Continued)

*Primary Examiner* — Mohammad M Ali
(74) *Attorney, Agent, or Firm* — Shumaker, Loop & Kendrick, LLP; James D. Miller

(57) ABSTRACT

The present invention relates to an evaporator (1000) and, more specifically, to an evaporator (1000), in which refrigerant is uniformly distributed to each area through 8-pass flow from a first area (A1) to an eighth area (A8) so as to reduce temperature variation and maximize the heat exchange efficiency with respect to outdoor air, and air is discharged to the left and right sides in a vehicle room with uniform temperature distribution so as to maintain the comfort of passengers.

13 Claims, 13 Drawing Sheets

(58) Field of Classification Search
USPC ..... 62/515, 244; 165/41, 42, 151, 153
See application file for complete search history.

(56) References Cited

U.S. PATENT DOCUMENTS

| | | | | |
|---|---|---|---|---|
| 2004/0256091 | A1* | 12/2004 | Higashiyama | F28D 1/0333 165/153 |
| 2007/0084589 | A1* | 4/2007 | Nishino | F28D 1/05391 165/152 |
| 2007/0131391 | A1* | 6/2007 | Ichiyanagi | F28D 1/0391 165/110 |
| 2011/0303401 | A1* | 12/2011 | Kamoshida | B60H 1/00335 165/173 |
| 2012/0096894 | A1* | 4/2012 | Higashiyama | F25B 39/02 62/525 |
| 2013/0312453 | A1* | 11/2013 | Jeon | F25B 39/028 62/524 |
| 2013/0312455 | A1* | 11/2013 | Jeon | F28D 1/0435 62/525 |

FOREIGN PATENT DOCUMENTS

| | | | |
|---|---|---|---|
| KR | 1020050035551 | A | 4/2005 |
| KR | 1020090048352 | A | 5/2009 |
| KR | 1020100132703 | A | 12/2010 |
| KR | 1020130130297 | A | 12/2013 |
| KR | 1020140001537 | A | 1/2014 |

* cited by examiner

EVAPORATOR

CROSS-REFERENCE TO RELATED APPLICATIONS

This patent application is a United States national phase patent application based on PCT/KR2015/008989 filed Aug. 27, 2015 which claims the benefit of Korean Patent Application No. 10-2014-0114298 filed Aug. 29, 2014 and Korean Patent Application No. 10-2015-0120913 filed Aug. 27, 2015. The entire disclosures of the above patent applications are hereby incorporated herein by reference.

TECHNICAL FIELD

The present invention relates to an evaporator and, more specifically, to an evaporator, in which refrigerant is uniformly distributed to each area through 8-pass flow from a first area to an eighth area so as to reduce temperature variation and maximize the heat exchange efficiency with respect to outdoor air, and air is discharged to the left and right sides in a vehicle room with uniform temperature distribution so as to maintain the comfort of passengers.

BACKGROUND OF THE INVENTION

In the recent automotive industry, there have been performed research and development for the improvement of fuel efficiency according to the increase of the global interest in the environment and energy. Also, in order to satisfy the various demands of users, there has been steadily performed research and development towards lightweight, compact and multi-functional automobiles as well as evaporators having increased thermal performance in a compact structure.

The evaporator is a component of an air conditioner system, in which the air introduced by an air blower is cooled by heat exchange while a liquid heat exchange medium is converted into a gas phase such that the cooled air is supplied to the inside of a vehicle.

FIG. 1 shows a prior art evaporator, and FIG. 2 to FIG. 4 respectively show the schematic flow refrigerant flow in the evaporator of FIG. 1, temperature interpretation result for the second line of the evaporator, and the refrigerant speed interpretation result thereof.

The prior art evaporator 80, as shown in FIG. 1 and FIG. 2, includes: a first header tank 10 and a second header tank 20, each of which inside is divided into a first line and a second line by a partition wall 70 and which are provided in parallel to each other at a predetermined distance from each other; an inlet pipe 30 and an outlet pipe 40, which are formed at one side of the first header tank 10; a baffle 50 provided to the inside of the first header tank 10 or the second header tank 20 so as to control the flow of refrigerant; and a core part 60 including a plurality of tubes 61, of which both ends are fixed to the first header tank 10 and the second header tank 20 and a plurality of fins 62 interposed between the tubes 61.

Herein, the refrigerant, introduced through the inlet pipe 30 into the first line, sequentially passes through: a first area A1 (from the top to the bottom) extending in the lengthwise direction in the first header tank 10 to the second header tank 20 through the tubes 61; a second area A2 (from the bottom to the top) extending to the first header tank 10 through other tubes 61; a third area A3 (from the top to the bottom) extending to the second header tank 20 again through still other tubes 61; a fourth area A4 (from the bottom to the top) extending to the second line through a communication part (not shown, a predetermined area of the partition wall in the second header tank 20 is formed to be hollow) and then extending to the first header tank 10; and a fifth area A5 (from the top to the bottom) extending to the second header tank 20 again through still other tubes 61; and a sixth area A6 (from the bottom to the top) extending to the first header tank 10 again through the other tubes 61 and, after that, is discharged through the outlet pipe 40.

However, as shown in FIG. 3 and FIG. 4, according to the prior art evaporator 80, the refrigerant is concentrated on the areas adjacent to the inlet pipe 30 and the outlet pipe. In particular, the second line provided with the outlet pipe 40 is likely to have an area, in which the refrigerant flow is weak by the concentration of the refrigerant due to the inertia thereof, and thus temperature becomes increased in this area. FIG. 4 shows sections of a predetermined speed or higher, indicated by oblique lines. More specifically, the evaporator 80 described above has areas of a relatively high temperature in the range of 8 to 10° C., wherein the temperature difference between the fourth area and the sixth area is the largest, which is 8° C. to the maximum. In addition, there are wide sections, of which a speed is below the predetermined speed. As described above, if the refrigerant distribution in the evaporator 80 is non-uniform, the thermal performance of the evaporator 80 becomes decreased and thus a temperature difference is generated in the air discharged to the left and right sides in the vehicle room, thereby decreasing the temperature comfort of users. The problems as described above become more serious when the amount of the refrigerant in the evaporator becomes decreased and thus the flow rate thereof becomes low.

Korean Reg. Patent No. 10-1130038 (Title of the Invention: Vehicle HVAC system using a 6-pass tube-fin type evaporator using refrigerant containing HFO 1234yf, Published: 20 Dec. 2010)

SUMMARY OF THE INVENTION

Accordingly, the present invention has been made in an effort to solve the above-mentioned problems occurring in the prior arts, and it is an objective of the present invention to provide an evaporator, comprising 8-pass flow from a first area to an eighth area so as to uniformly distribute refrigerant to the respective areas, thereby reducing temperature variation and increasing the heat exchange efficiency with respect to outdoor air, wherein air is discharged to the left and right sides in a vehicle room with uniform temperature distribution so as to maintain the comfort of passengers.

To achieve the above objectives, the present invention provides an evaporator, comprising: a first header tank and a second header tank, each of which inside is divided into a first line and a second line by a partition wall, and arranged in parallel to each other at a predetermined distance from each other; baffles provided to the inside of the first header tank and the second header tank so as to control the flow of refrigerant; and a core part including a plurality of tubes, of which both ends are respectively fixed to the first line and the second line of the first header tank and the second header tank, and fins interposed between the tubes, wherein the tubes respectively have four or more areas, provided to the first line and the second line, for movement from the first header tank to the second header tank or from the second header tank to the first header tank.

Herein, the evaporator includes an inlet pipe communicating with the first line, and an outlet pipe communicating with the second line, the both being in parallel to each other at one side of the first header tank, and the refrigerant, introduced through the inlet pipe in the first line of the tubes, sequentially passes through a first area for the movement from the first header tank to the second header tank, a second area for the movement from the second header tank to the first header tank, a third area for the movement from the first header tank to the second header tank, and a fourth area for the movement from the second header tank to the first header tank, so as to move to the second line, and sequentially passes through a fifth area for the movement from the first header tank to the second header tank, a sixth area for the movement from the second header tank to the first header tank, a seventh area for the movement from the first header tank to the second header tank, and an eighth area for the movement from the second header tank to the first header tank, so as to be discharged through the outlet pipe.

That is, the evaporator according to the present invention has 8-pass flow from the first area to the eighth area so as to uniformly distribute the refrigerant to each of the areas, thereby reducing temperature variation. Therefore, according to the evaporator of the present invention, it is possible to maximize the heat exchange efficiency with respect to outdoor air. In addition, the air discharged to the left and right sides in a vehicle room can have uniform temperature distribution, thereby maintaining the comfort of passengers.

Furthermore, the evaporator has the plurality of tubes, of which flow paths respectively have the same flow path area and the same full circumference length and which have a hydraulic diameter in the range of 1.0 to 2.8 mm, and the core part, of which width is 150 to 300 mm. Therefore, the evaporator of the present invention has advantages of improving thermal performance while reducing temperature variation.

In addition, the number of the tubes forming the first area and the number of the tubes forming the eighth area are the same as each other, the number of the tubes forming the second area and the number of the tubes forming the seventh area are the same as each other, the number of the tubes forming the third area and the number of the tubes forming the sixth area are the same as each other, and the number of the tubes forming the fourth area and the number of the tubes forming the fifth area are the same as each other, such that the baffles are provided at the same positions so as to be symmetrical to each other in the width direction and, thus, the manufacturing process can be simplified.

Also, the first header tank and the second header tank respectively have the same number of the baffles, which are located in the first line and the second line, wherein the baffles located in the first line and the second line of the first header tank and the second header tank respectively have the same positions in the lengthwise direction, thereby further improving manufacturability.

Herein, the evaporator has the same number of tubes which form the opposite areas of the first line and the second line, wherein it is possible to form the evaporator in such a manner that the number of the tubes of the eighth area is smaller than or equal to the number of the tubes of the seventh area and the number of the tubes of the seventh area is smaller than or equal to the number of the tubes of the sixth area. In other words, according to the evaporator of the present invention, the number of the tubes forming an area, which is adjacent to an outlet, is smaller than or equal to the number of the tubes forming neighboring areas such that the concentration of the refrigerant on the area adjacent to the outlet can be prevented.

Therefore, the evaporator according to the present invention has 8-pass flow from the first area to the eighth area so as to uniformly distribute refrigerant to each of the areas, thereby reducing temperature variation and maximizing the heat exchange efficiency with respect to outdoor air, and also has an advantage of uniform temperature distribution in the air discharged to the right and left sides in a vehicle room, thereby maintaining the comfort of passengers.

EXPLANATION OF ESSENTIAL REFERENCE NUMERALS IN THE DRAWINGS

| | |
|---|---|
| 1000: evaporator | |
| 100: first header tank | 200: second header tank |
| 300: inlet pipe | 400: outlet pipe |
| 500: core part | 510: tubes |
| 520: fins | 530: side plate |
| 600: baffles | 700: partition wall |
| Wcore: width of core part | |
| A1: first area | A2: second area |
| A3: third area | A4: fourth area |
| A5: fifth area | A6: sixth area |
| A7: seventh area | A8: second area |
| St: flow path area of tube | |
| Lt: flow path full circumference length of tubes | |

DETAILED DESCRIPTION OF EXEMPLARY EMBODIMENTS OF THE INVENTION

Hereinafter, an evaporator having the above-mentioned features according to the preferred embodiments of the present invention will be described in detail with reference to the attached drawings.

Figure 5:
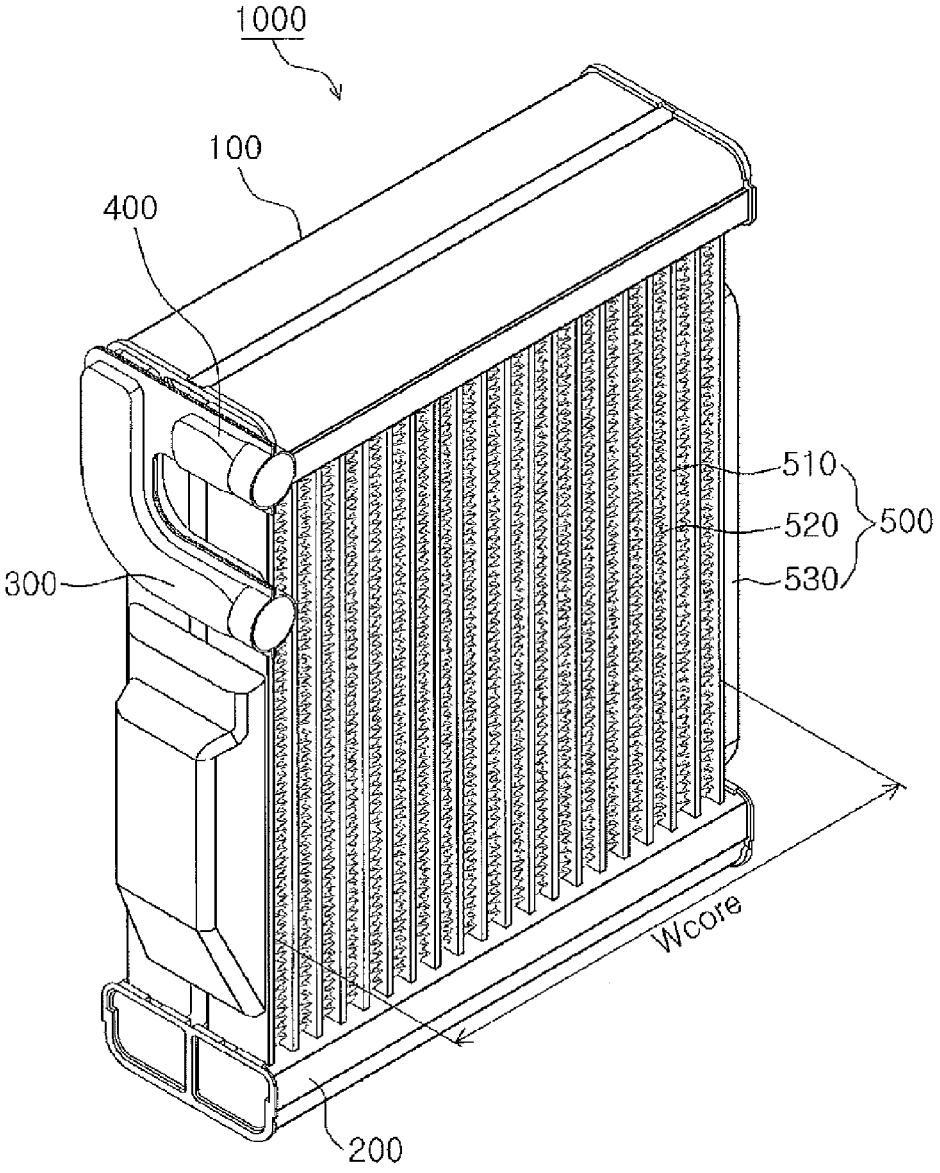
FIG. 5 is a top perspective view for showing an evaporator according to an embodiment of the present invention.
Figure 6:
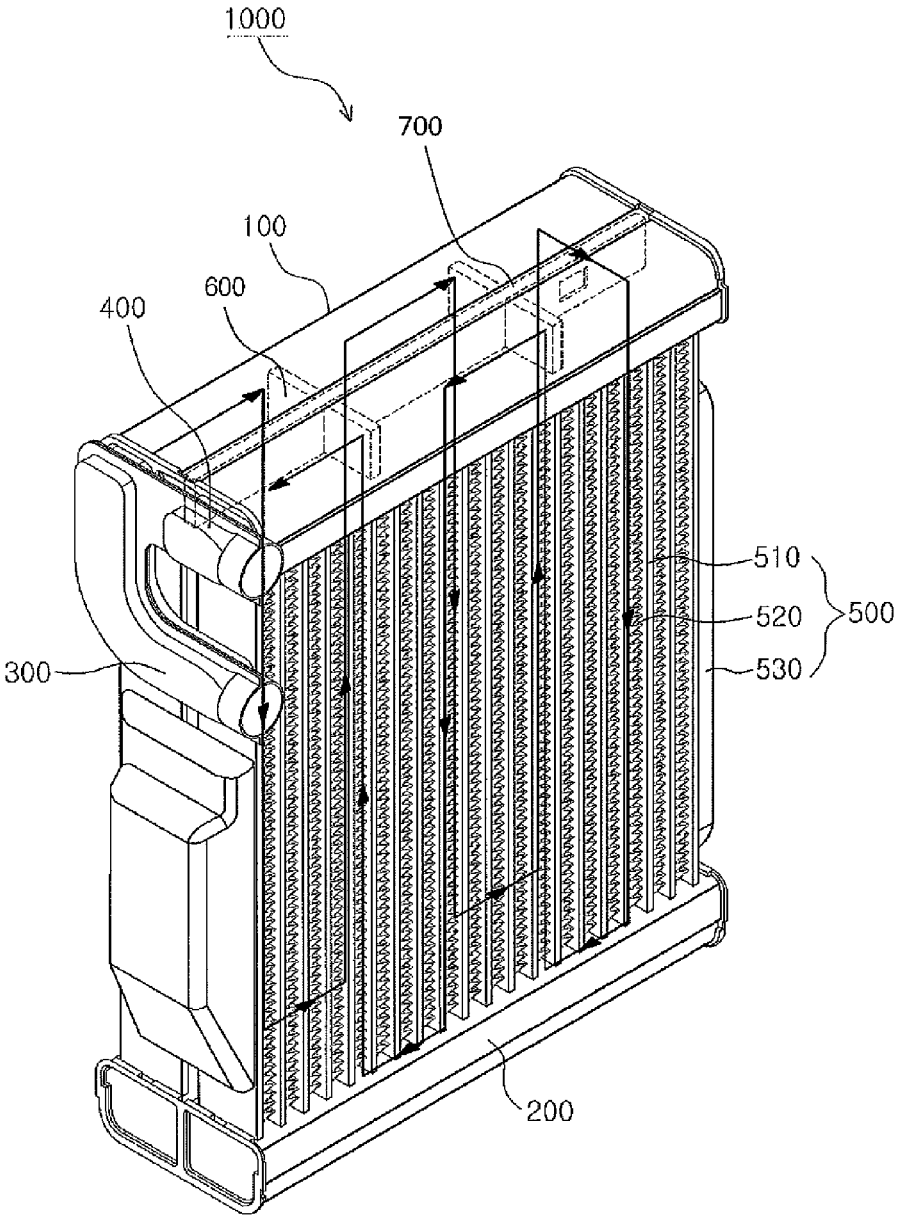
FIG. 6 and FIG. 7 are schematic top perspective views for showing the refrigerant flows of the evaporator shown in FIG. 5, wherein portions of the evaporator are shown in phantom lines.
Figure 7:
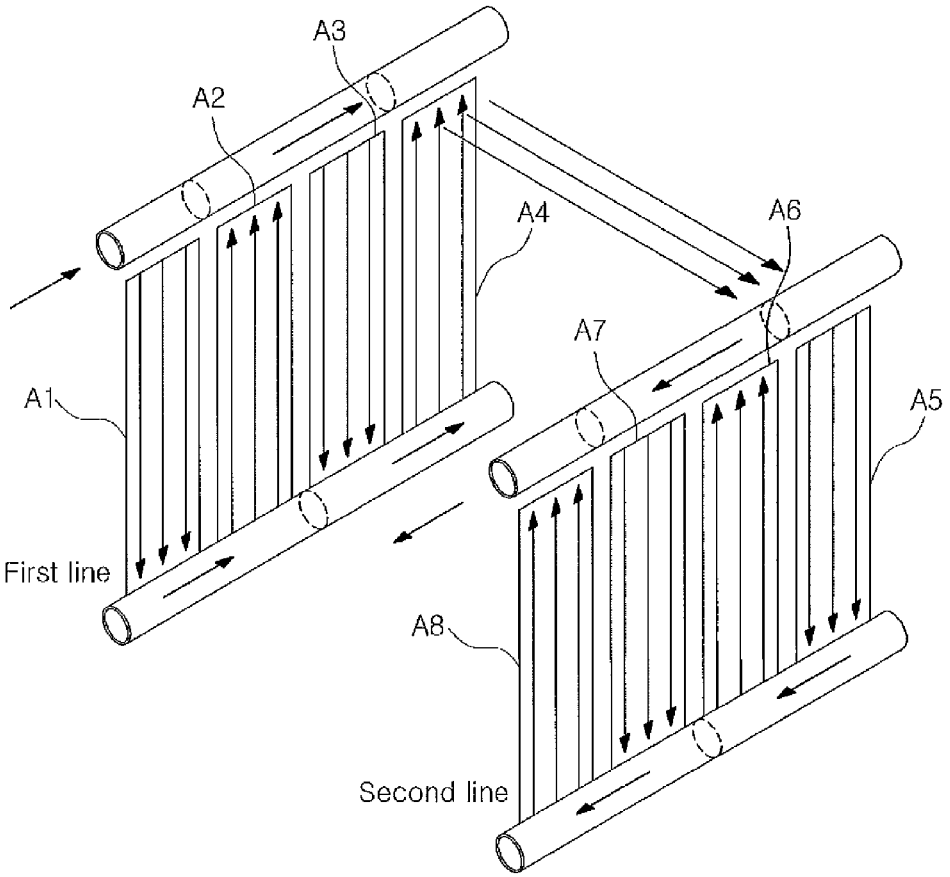
Figure 8:
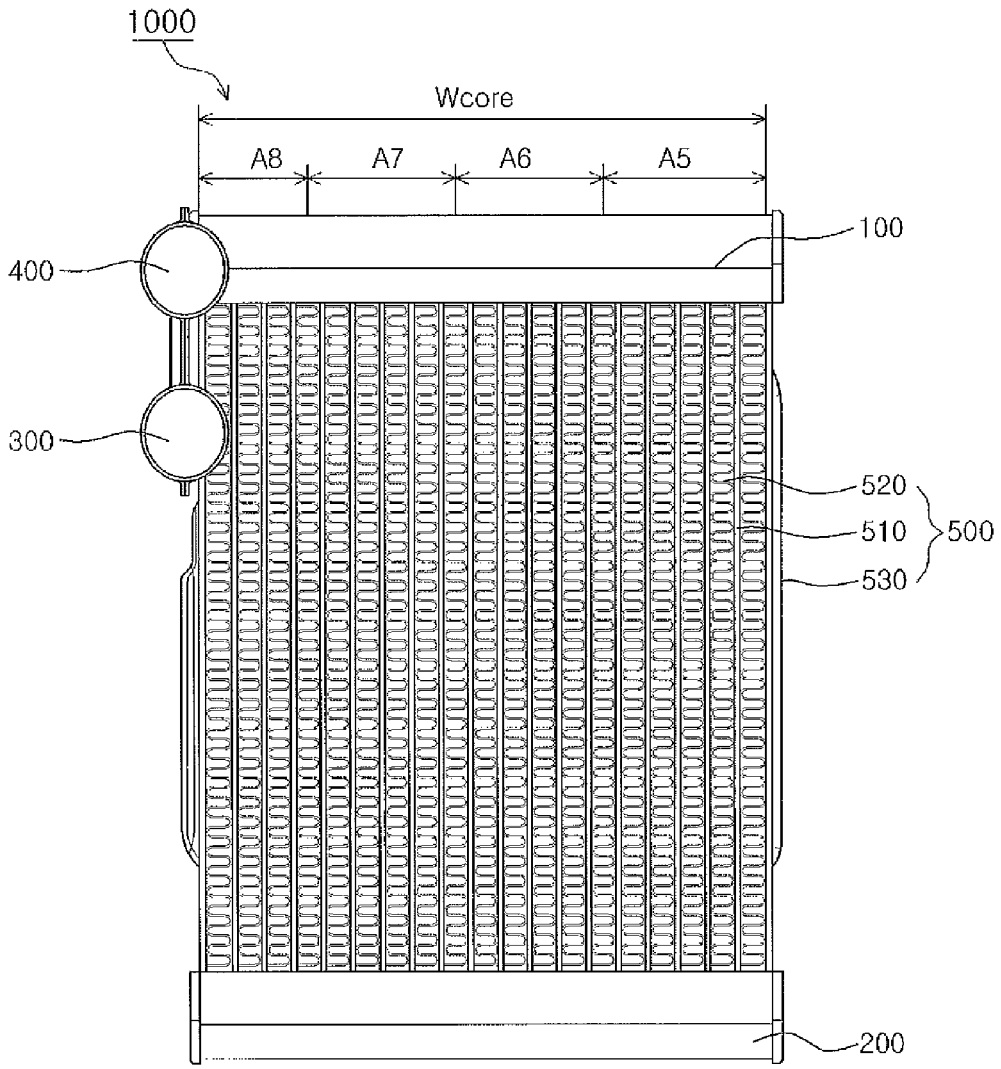
FIG. 8 is a front elevational view showing the evaporator shown in FIG. 5.
Figure 9A:
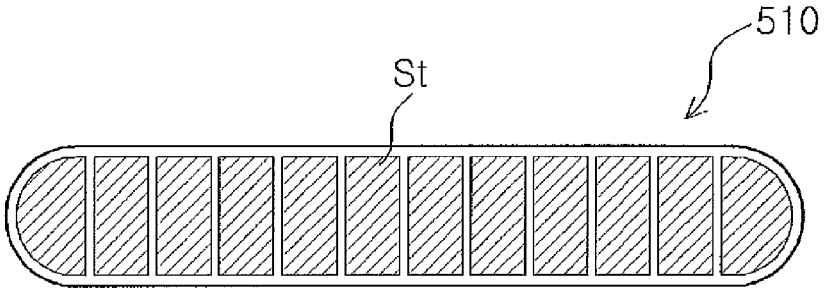
FIG. 9A and FIG. 9B are top plan views for showing the shapes of tubes and fins of the evaporator shown in FIG. 5 in detail.
Figure 9B:
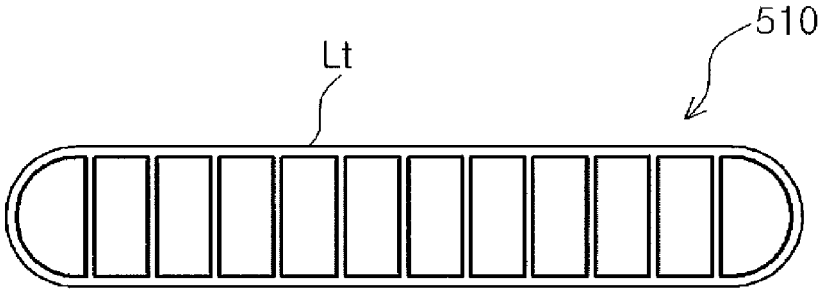
Figure 10:
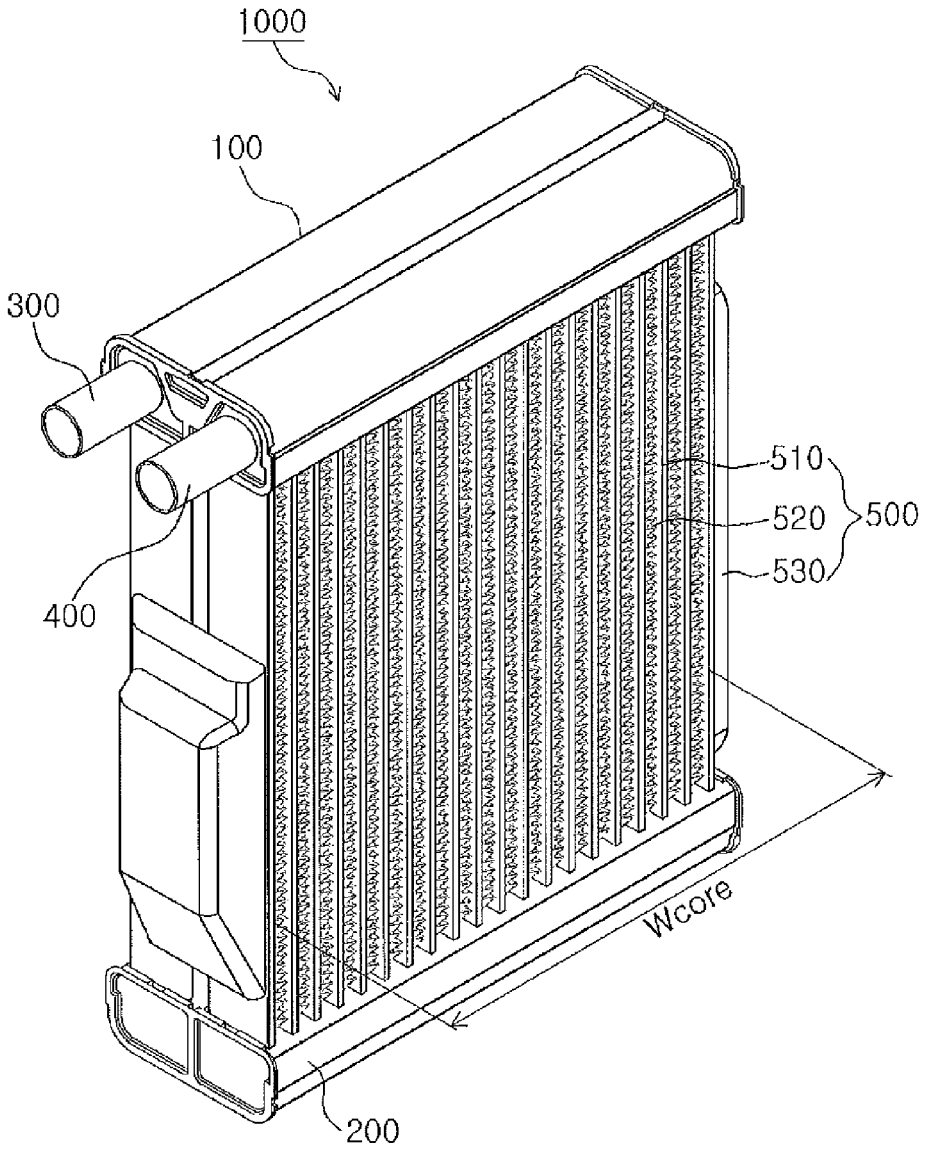
FIG. 10 is a top perspective view for showing the evaporator according to another embodiment of the present invention.
Figure 11:
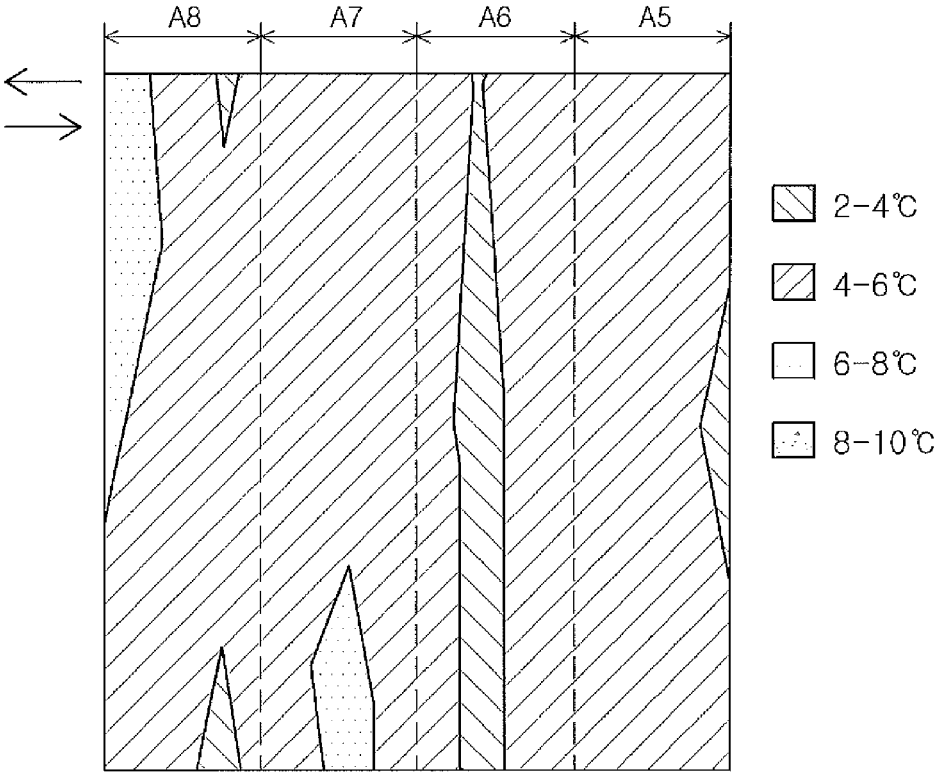
FIG. 11 is a temperature interpretation graph for a second line side of the evaporator according to the present invention.
Figure 12:
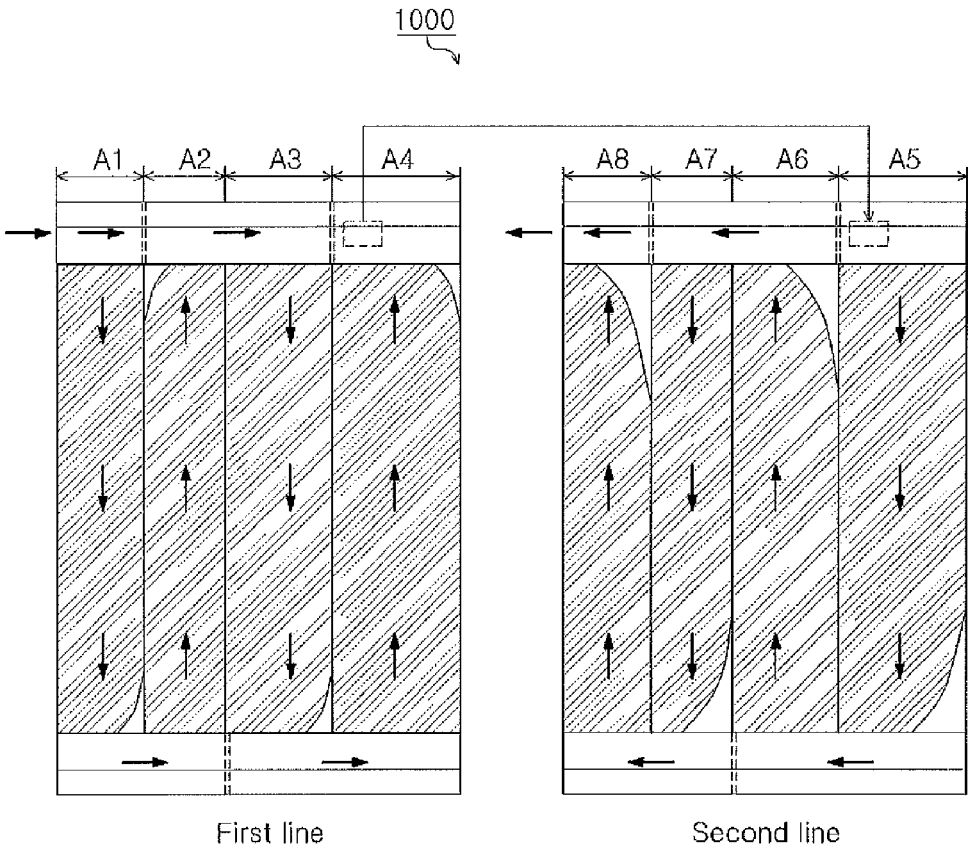
FIG. 12 is a refrigerant speed interpretation graph for the evaporator according to the present invention.
Figure 13:
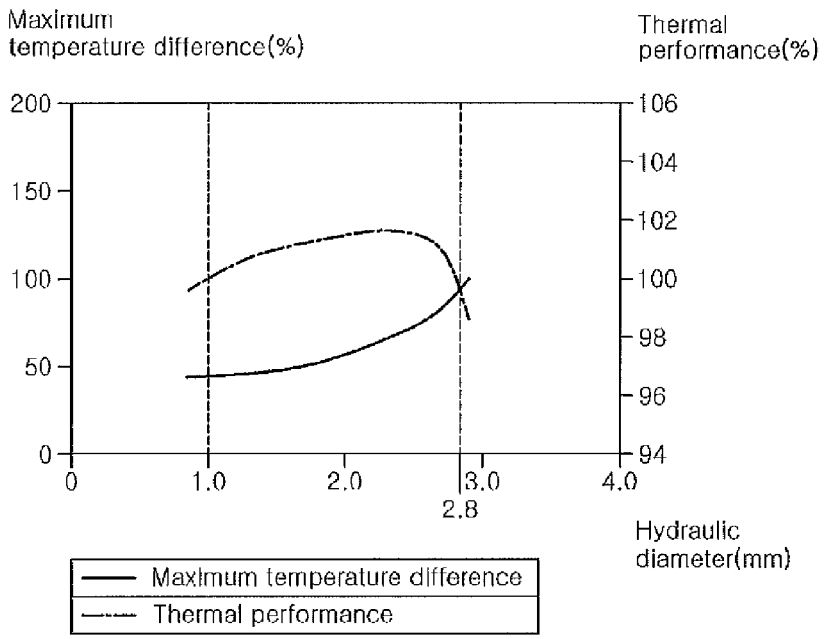
FIG. 13 is a graph for showing the relations between the hydraulic diameter of the tubes, and a maximum temperature difference and thermal performance of the evaporator according to the present invention.
Figure 14:
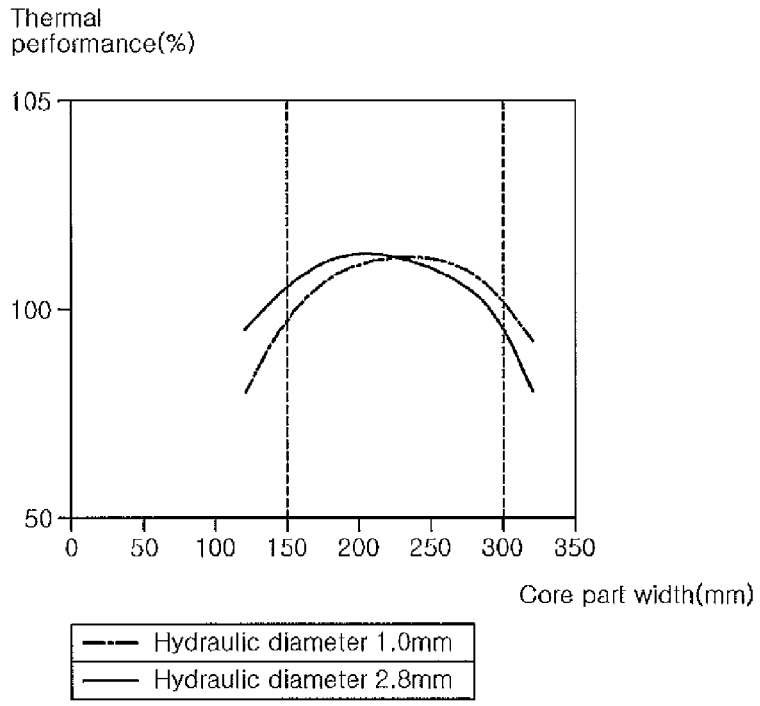
FIG. 14 is a graph for showing the relations between a core part width and thermal performance of the evaporator according to the present invention.

FIG. 5 is a perspective view for showing an evaporator 1000 according to an embodiment of the present invention, FIG. 6 and FIG. 7 are views for showing the refrigerant flows of the evaporator 1000 shown in FIG. 5, FIG. 8 is a front view showing the evaporator 1000 shown in FIG. 5, FIG. 9A and FIG. 9B are views for showing the shapes of tubes 510 of the evaporator 1000 shown in FIG. 5 in detail, FIG. 10 is a perspective view for showing an evaporator 1000 according to another embodiment of the present invention, FIG. 11 is a temperature interpretation graph for a second line side of the evaporator 1000 according to the present invention, FIG. 12 is a refrigerant speed interpretation graph for the evaporator 1000 according to the present invention, FIG. 13 is a graph for showing the relations between the hydraulic diameter of the tubes 510, and a maximum temperature difference and thermal performance, and FIG. 14 is a graph for showing the relations between a core part width Wcore and thermal performance.

The evaporator 1000 according to the present invention includes a first header tank 100, a second header tank 200, baffles 600, and a core part 500.

The first header tank 100 and the second header tank 200 are provided to be spaced from each other at a predetermined distance, wherein the inside of each of the first header tank 100 and the second header tank 200 is divided into a first line and a second line by a partition wall 700 and the first header tank 100 and the second header tank 200 are respectively connected to an inlet pipe 300, through which refrigerant is introduced, and an outlet pipe 400. Herein, the first line is connected to the inlet pipe 300 such that the refrigerant can be introduced through the inlet pipe 300, and the second line is connected to the outlet pipe 400 such that the refrigerant can be discharged through the outlet pipe 400. The inlet pipe 300 and the outlet pipe 400 are respectively formed in the shape of a pipe so as to be connected to one side of the first header tank 100 in parallel to each other (see FIG. 10), and may be formed in the shape of a "C"-type manifold (see FIG. 5 to FIG. 8). In particular, explaining the inlet pipe 300 and the outlet pipe 400, which are formed in the shape of a "C"-type manifold, the inlet pipe 300 communicates with the first line and extends in the downward direction and then in the width direction by being folded, and the outlet pipe 400 communicates with the second line and extends in the width direction. In the present invention, the "C"-type manifold shape indicates that the inlet pipe 300 and the outlet pipe 400 are in the shape of a "C" on the whole when the evaporator 1000 is viewed at one side of the first header tank 100, wherein a manifold structure for forming the inlet pipe 300 and the outlet pipe 400 may include a first member (the reference sign thereof is not shown), which is directly coupled to the first header tank 100, and a second member (the reference sign thereof is not shown), which is coupled with the first member so as to form a refrigerant flow space therein. In addition, FIG. 5 to FIG. 8 show an example, in which the inlet pipe 300 and the outlet pipe 400 are extended in the width direction, that is, towards the front side on the drawings where the second line is positioned.

Referring to FIG. 5 to FIG. 8 and FIG. 10, the first header tank 100 and the second header tank 200 are spaced from each other in the height direction, wherein the first header tank 100 is positioned at the upper side in such a manner that the first line is formed at the rear side and the second line is formed at the front side. Even though FIG. 5 to FIG. 8 and FIG. 10 show that the inlet pipe 300 and the outlet pipe 400 are positioned at the left side, the evaporator 1000 of the present invention is not limited thereto and the first header tank 100 and the second header tank 200 may be oppositely positioned in the vertical direction or spaced from each other in the left and right directions. Also, the positions of the first line and the second line may be changed in the same way.

The baffles 600 are means provided to the inside of the first header tank 100 and the second header tank 200 so as to control the flow of the refrigerant, and are formed in the shape of a plate for blocking the refrigerant in the lengthwise direction of the first header tank 100 and the second header tank 200, wherein the number of the tubes 510 for forming a first area A1 to an eighth area A8 can be adjusted by controlling the positions of the baffles 600.

The core part 500 includes the tubes 510 and fins 520 and may further include side plates at both sides so as to support the tubes 510 and the fins 520.

The tubes 510 are respectively fixed to the first line and the second line, formed by the first header tank 100 and the second header tank 200, at both ends thereof so as to form refrigerant flow paths, and the fins 520 are interposed between the tubes 510.

Herein, there are a plurality of the tubes 510, all of which are in the same shape. More specifically, each of the plurality of tubes 510 has the same flow path area and each of the flow paths has the same full circumference length. In addition, it is preferable that 4 or more areas, extending from the first header tank 100 to the second header tank 200 or from the second header tank 200 to the first header tank 100 in the first line and the second line, are respectively provided to the tubes 510 in the lengthwise direction. In particular, the tubes 510 are provided with the first area A1 to a fourth area A4, for transferring the refrigerant introduced through the inlet pipe 300, in the first line and a fifth area A5 to the eighth area A8 in the second line. More specifically, the first area A1 to the fourth area A4 are formed by the tubes 510 in the first line in sequence along the lengthwise direction of the first header tank 100. The first area A1 is an area, into which the refrigerant introduced through the inlet pipe 300 first flows, wherein the refrigerant introduced through the inlet pipe 300 flows in the lengthwise direction of the first header tank 100 to a portion blocked by the baffle 600 and then to the second header tank 200. A second area A2 is an area, into which the refrigerant passing through the first area A1 flows, wherein the second area A2 is formed in the vicinity of the first area A1 in the lengthwise direction of the first header tank 100 such that the refrigerant of the second header tank 200 flows to the first header tank 100. A third area A3 is an area, to which the refrigerant passing through the second area A2 flows, wherein the third area A3 is formed in the vicinity of the second area A2 in the lengthwise direction of the first header tank 100 such that the refrigerant of the first header tank 100 flows to the second header tank 200. The fourth area A4 is an area, to which the refrigerant passing through the third area A3 flows, wherein the fourth area A4 is formed in the vicinity of the third area A3 in the lengthwise direction of the first header tank 100 such that the refrigerant of the second header tank 200 flows to the first header tank 100.

Further, the fifth area A5 to a sixth area A6 are areas formed by the tubes 510 in the second line, wherein, after the refrigerant passing through the fourth area A4 flows to the second line, the refrigerant of the first header tank 100 flows to the second header tank 200. The sixth area A6 is an area, to which the refrigerant passing through the fifth area A5 flows, wherein the sixth area A6 is formed in the vicinity of the fifth area A5 in the lengthwise direction of the first header tank 100 such that the refrigerant of the second header tank 200 flows to the first header tank 100. A seventh area A7 is an area, to which the refrigerant passing through the sixth area A6 flows, wherein the seventh area A7 is formed in the vicinity of the sixth area A6 in the lengthwise direction of the first header tank 100 such that the refrigerant of the first header tank 100 flows to the second header tank 200. The eighth area A8 is an area, to which the refrigerant passing through the seventh area A7 flows, wherein the eighth area A8 is formed in the vicinity of the seventh area A7 in the lengthwise direction of the first header tank 100 such that the refrigerant of the second header tank 200 flows to the first header tank 100. The eighth area A8 is a part communicating with the outlet pipe 400 such that the refrigerant introduced through the inlet pipe 300 flows from the first area A1 to the eighth area A8 in sequence and then is discharged through the outlet pipe 400.

That is, the evaporator 1000 according to the present invention has the 8-pass flow from the first area A1 to the eighth area A8, wherein the refrigerant is uniformly distributed to each of the areas, thereby reducing temperature variation. Therefore, the evaporator 1000 according to the present invention can maximize the heat exchange efficiency with respect to the outdoor air and maintain the comfort of passengers through the uniform temperature distribution of the air discharged to the left and right sides in a vehicle room.

In particular, the evaporator 1000 according to the present invention may be formed such that the number of the tubes 510 of the eighth area A8 is smaller than or equal to the number of the tubes 510 of the seventh area A7, the number of the tubes 510 of the seventh area A7 is smaller than or equal to the number of the tubes 510 of the sixth area A6, and the number of the tubes 510 of the sixth area A6 is smaller than or equal to the number of the tubes 510 of the fifth area A5.

FIG. 8 shows an example, wherein the numbers of the tubes 510 of the eighth area A8 and the seventh area A7 are respectively to be 4, and the numbers of the tubes 510 of the sixth area AG and the fifth area A5 are respectively to be 5. However, the evaporator 1000 according to the present invention is not limited to the above example. Table 1 shows the number of the tubes 510 forming the respective areas in the evaporator 1000 according to the present invention. In the Table 1 the total number of the tubes 510 means the number of lines of the tubes positioned in the lengthwise direction of the first header tank 100.

TABLE 1

| total number of tubes 510 | 1st area A1 (8th area A8) | 2nd area A2 (7th area A7) | 3rd area A3 (6th area A6) | 4th area A4 (5th area A5) |
|---|---|---|---|---|
| 4N | N | N | N | N |
| 4N + 1 | N | N | N | N + 1 |
| 4N + 2 | N | N | N + 1 | N + 1 |
| 4N + 3 | N | N + 1 | N + 1 | N + 1 |

(N is an integer equal to or higher than 1.)

In the evaporator 1000 according to the present invention, the numbers of the tubes 510 forming the fifth area A5 to the eighth area A8 are limited since the areas of the second line first meet the air in the air flow direction. Therefore, the air passes through the second line first and then passes through the first line such that the temperature variation of the second line is larger than the temperature variation of the first line. Accordingly, in the case of the evaporator 1000, the air primarily cooled in the second line is cooled again in the first line. Therefore, in order to reduce the air temperature variation on the whole, it is important to release the concentration of the refrigerant in the second line.

In other words, according to the evaporator 1000 of the present invention, the number of the tubes 510 forming an area, which is adjacent to the outlet pipe 400, is smaller than or equal to the number of the tubes 510 forming neighboring areas thereof such that the concentration of the refrigerant on the area adjacent to the outlet pipe 400 can be prevented. Herein, since die number of the tubes 510 may be not a multiple of 4, it is possible to arrange the tubes 510 in such a manner that the number of the tubes 510 of the eighth area A8, which is nearest to the outlet, is smaller than or equal to the number of the tubes 510 of the seventh area A7, the number of the seventh area A7 is smaller than or equal to the number of the tubes 510 of the sixth area A6, and the number of the sixth area A6 is smaller than or equal to the number of the tubes 510 of the fifth area A5.

In addition, the numbers of the tubes 510 forming the opposite areas of the first line and the second line may be the same. More specifically, it is preferable that the number of the tubes 510 forming the first area A1 is the same as the number of the tubes 510 forming the eighth area A8, the numbers of the tubes 510 respectively forming the second area A2 and the seventh area A7 are the same as each other, the numbers of the tubes 510 respectively forming the third area A3 and the sixth area A6 are the same as each other, and the numbers of the tubes 510 respectively forming the fourth area A4 and the fifth area A5 are the same as each other. In other words, the numbers of the tubes 510 respectively forming the first area A1 and the eighth area A8 which are arranged in parallel to each other in the width direction are the same as each other, the numbers of the tubes 510 respectively forming the second area A2 and the seventh area A7 which are arranged in parallel to each other in the width direction are the same as each other, the numbers of the tubes 510 respectively forming the third area A3 and the sixth area A6 which are arranged in parallel to each other in the width direction are the same as each other, and the numbers of the tubes 510 respectively forming the fourth area A4 and the fifth area A5 which are arranged in parallel to each other in the width direction are the same as each other. Therefore, the evaporator 1000 according to the present invention has advantages that the same number of baffles 600 are respectively provided to the first line and the second line in the first header tank 100 and the second header tank 200 so as to control the refrigerant flow in the first header tank 100 and the second header tank 200 and the baffles 600 are provided at the same positions in the lengthwise direction in the first line and the second line, thereby simplifying manufacturing work.

Meanwhile, it is preferable that the evaporator 1000 according to the present invention has a hydraulic diameter of the tubes 510 in the range of 1.0 millimeters (mm) to 2.8 mm. The hydraulic diameter indicates 4× flow path areas (St) of the tubes (510)/full circumference length (Lt) of entire flow paths of the tubes (510).

Meanwhile, FIG. 9A and FIG. 9B respectively show the cross-sections of the tubes 510, in which FIG. 9A shows the flow path areas St of the tubes 510, the total areas of the respective parts through which the refrigerant flows, with oblique lines, and FIG. 9B shows the full circumference length Lt of the respective parts, through which the refrigerant flows, and circumferential lengths with thick lines on the cross section of the tubes 510.

Figure 1:
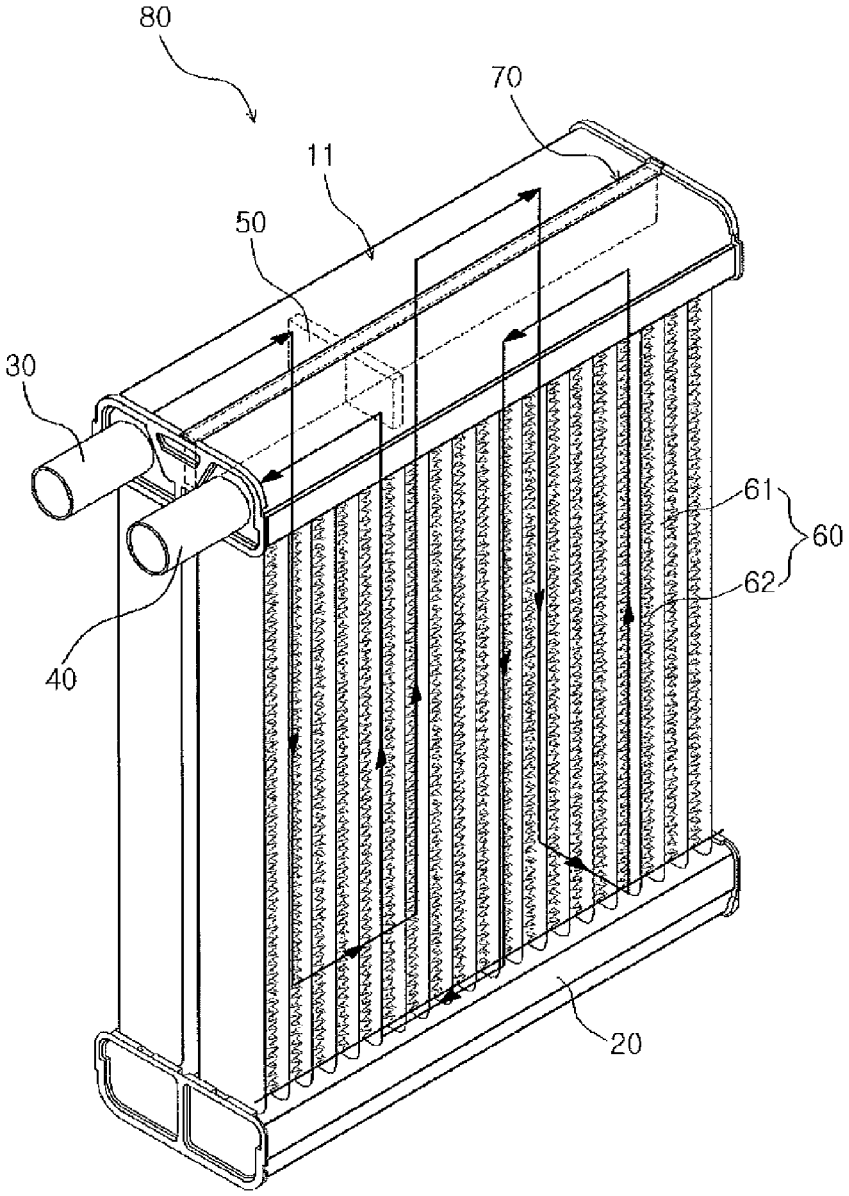
PRIOR ART FIG. 1
FIG. 1 and FIG. 2 are respectively a top perspective view for showing a prior art evaporator and a schematic top perspective view of the evaporator of FIG. 1 for showing the flow of refrigerant, wherein portions of the evaporator are shown in phantom lines.
Figure 2:
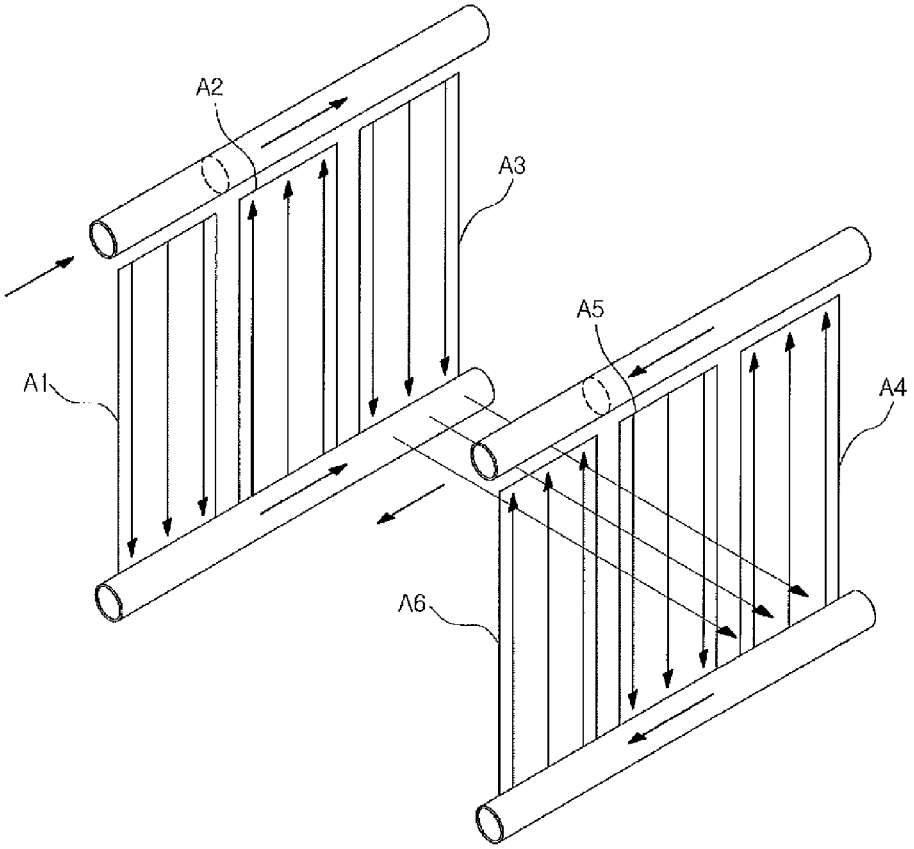
PRIOR ART FIG. 2
Figure 3:
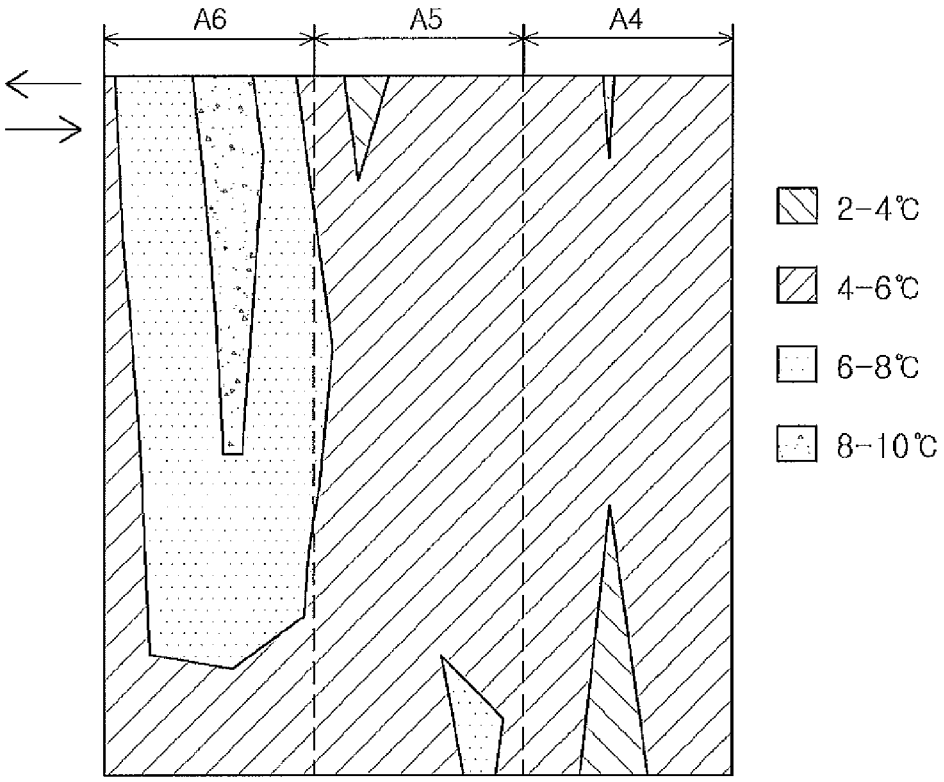
PRIOR ART FIG. 3
FIG. 3 is a temperature interpretation graph for a second line side of the evaporator shown in FIG. 1 and FIG. 2.
Figure 4:
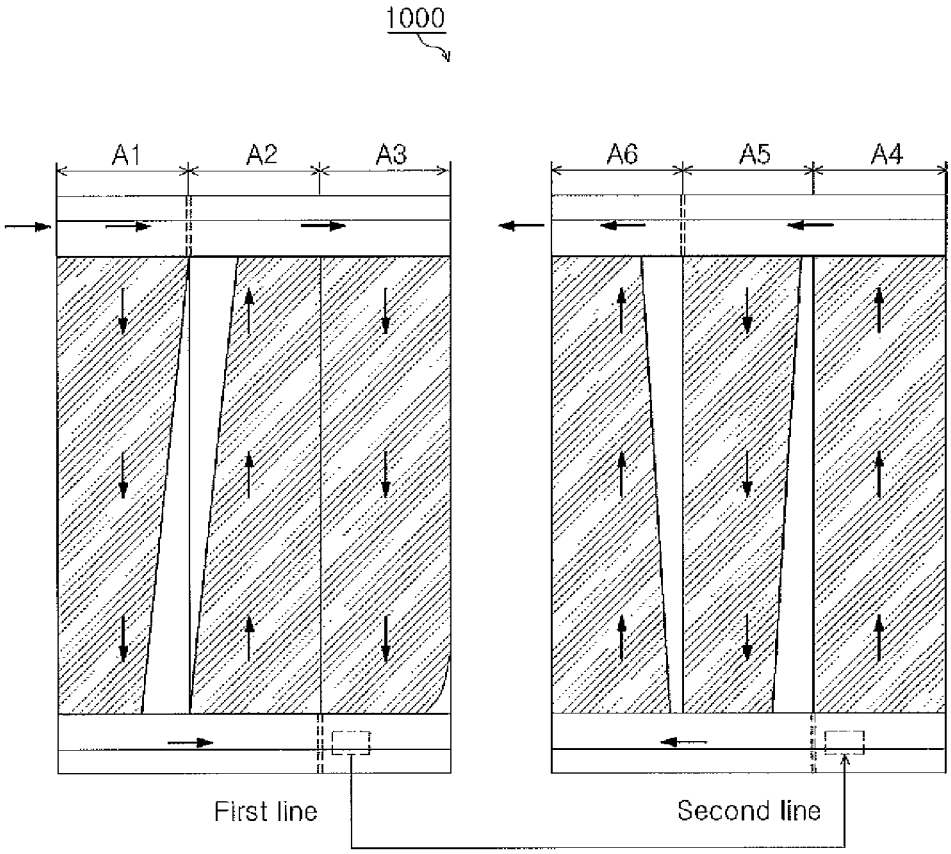
PRIOR ART FIG. 4
FIG. 4 is a refrigerant speed interpretation graph for the evaporator shown in FIG. 1 and FIG. 2.

FIG. 11 is a temperature interpretation graph for the second line side of the evaporator 1000 according to the present invention, and FIG. 12 is a refrigerant speed interpretation graph for the evaporator 1000 according to the present invention. Referring to FIG. 11, it could be noted that the temperature interpretation graph for the second line side of the evaporator 1000 according to the present invention had no section of temperature in the range of 8 to 10° C. and the areas of temperature in the range of 6 to 8° C. were also reduced, in comparison with the temperature interpretation graph of the prior art evaporator, as shown in FIG. 3. In addition, areas of a predetermined speed or higher are shown with oblique lines. Referring to FIG. 12, it could be noted that the refrigerant speed interpretation graph for the evaporator 1000 according to the present invention had sections below the predetermined speed, which were much reduced, in comparison with the refrigerant speed interpretation graph of the prior art evaporator, as shown in FIG. 4. That is, the evaporator 1000 according to the present invention can reduce the concentration of the refrigerant due to the inertia thereof and the temperature variation resulted from such refrigerant concentration in the vicinity of the areas provided with the inlet pipe 300 and the outlet pipe 400 such that the temperature difference of the air discharged to the left and right sides in a vehicle room and the overall thermal performance can be further increased.

Furthermore, the thermal performance is rapidly decreased if the hydraulic diameter of the tubes 510 is less than 1.0 mm, and the maximum temperature difference is increased if the hydraulic diameter of the tubes 510 exceeds 2.8 mm, as shown in FIG. 13. Therefore, it is preferable that the hydraulic diameter of the tubes 510 is formed to be in the range of 1.0 mm to 2.8 mm in the evaporator 1000 according to the present invention so as to reduce the maximum temperature difference and sufficiently secure the thermal performance.

In addition, it is preferable that the width Wcore of the core part is formed to be in the range of 150 mm to 300 mm in the evaporator 1000 according to the present invention. FIG. 14 shows a graph for showing the relations between the tubes 510, of which hydraulic diameter is 1.0 mm and the core part width Wcore is 2.8 mm, and the thermal performance. It could be noted that the thermal performance was rapidly decreased when the core part width Wcore was less than 150 mm or exceeded 300 rum.

In other words, the evaporator 1000 according to the present invention has advantages that the hydraulic diameter of the tubes 510 is formed to be in the range of 1 to 2.8 mm and the width Wcore of the core part is formed to be in the range of 150 to 300 mm, thereby reducing the temperature variation and improving the thermal performance.

It should be understood that there is no intent to limit the present invention to the particular forms of the embodiments mentioned above. It should be further understood that the present invention can be applied in a various fields and various modifications can be made thereto without departing from the scope of the present invention.

The invention claimed is:

1. An evaporator comprising:

a first header tank including a first partition wall, the first partition wall dividing the first header tank into a first line and a second line;

a second header tank parallel to and spaced apart from the first header tank at a predetermined distance, the second header tank including a second partition wall, the second partition wall dividing the second header tank into a first line and a second line;

a plurality of baffles disposed within each of the first header tank and the second header tank, the plurality of baffles of the first header tank controlling a refrigerant flowing through the first header tank, the plurality of baffles of the second header tank controlling the refrigerant flowing through the second header tank;

a core part including a plurality of tubes and a plurality of fins, the plurality of tubes fixed to and extending between the first header tank and the second header tank, the plurality of fins interposed between the plurality of tubes, wherein the plurality of tubes cooperate with the plurality of baffles of each of the first header tank and the second header tank to divide the plurality of tubes into a first area, a second area, a third area, a fourth area, a fifth area, a sixth area, a seventh area, and an eighth area, wherein the first area, the second area, the third area, and the fourth area extend between the first line of the first header tank and the first line of the second header tank and the fifth area, the sixth area, the seventh area, and the eighth area extend between the second line of the first header tank and the second line of the second header tank; and an inlet pipe in fluid communication with the first line of the first header tank and an outlet pipe in fluid communication with the second line of the first header tank, the inlet pipe parallel with the outlet pipe, wherein the first header tank is formed with a hole for fluid communication from the first line to the second line.

2. The evaporator of claim 1, wherein a first portion of the inlet pipe extends from the first header tank in a height direction of the evaporator and a second portion of the inlet pipe extending from the first portion of the inlet pipe in a width direction of the evaporator, the outlet pipe extending from the first header tank in the width direction of the evaporator, the inlet pipe and the outlet pipe forming a manifold having a C-shape.

3. The evaporator of claim 2, wherein the refrigerant is conveyed into the evaporator through the inlet pipe, the refrigerant flows sequentially through the first area from the first line of the first header tank to the first line of second header tank, the second area from the first line of the second header tank to the first line of the first header tank, the third area from the first line of the first header tank to the first line of the second header tank, the fourth area from the first line of the second header tank to the first line of the first header tank, the fifth area from the second line of the first header tank to the second line of the second header tank, the sixth area from the second line of the second header tank to the second line of the first header tank, the seventh area from the second line of the first header tank to the second line of the second header tank, and the eight area from the second line of the second header tank to the second line of the first header tank, the refrigerant discharged from the evaporator through the outlet pipe.

4. The evaporator of claim 3, wherein the plurality of tubes have a flow path area equal to each other and a full circumference length equal to each other.

5. The evaporator of claim 4, wherein each of the plurality of tubes have a hydraulic diameter in a range of about 1.0 millimeters to about 2.8 millimeters, the hydraulic diameter is defined by the following equation:

$$\text{hydraulic diameter}=4*(St)/(Lt),$$

wherein St is the flow path area of each of the plurality of tubes and Lt is the full circumference length of each of the plurality of tubes.

6. The evaporator of claim 5, wherein a width of the core part is in a range of about 150 millimeters to about 300 millimeters.

7. The evaporator of claim 4, wherein a total number of the plurality of tubes forming the eighth area is one of less than and equal to a total number of the plurality of tubes in the seventh area.

8. The evaporator of claim 4, wherein a total number of the plurality of tubes in the seventh area is one of less than and equal to a total number of the plurality of tubes in the sixth area.

9. The evaporator of claim 4, wherein a total number of the plurality of tubes in the sixth area is one of less than and equal to a total number of the plurality of tubes in the fifth area.

10. The evaporator of claim 4, wherein a total number of the plurality of baffles in the first header tank is equal to a total number of the plurality of baffles in the second header tank, and wherein each of the first line of the first header tank, the second line of the first header tank, the first line of the second header tank, and the second line of the second header tank has at least one of the plurality of baffles disposed therein.

11. The evaporator of claim 9, wherein the at least one baffle disposed in the first line of the first header tank aligns with the at least one baffle disposed in the second line of the first header tank with respect to a length direction of the evaporator and the at least one baffle disposed in the first line of the second header tank aligns with the at least one baffle disposed in the second line of the second header tank with respect to the length direction of the evaporator.

12. The evaporator of claim 10, wherein the first area aligns with the eighth area with respect to the length direction of the evaporator, the second area aligns with the seventh area with respect to the length direction of the evaporator, the third area aligns with the sixth area with respect to the length direction of the evaporator, and the fourth area aligns with the fifth area with respect to the length direction of the evaporator.

13. The evaporator of claim 11, wherein a total number of the plurality of tubes in the the first area is equal to a total number of the plurality of tubes in the eighth area, a total number of the plurality of tubes in the second area is equal to a total number of the plurality of tubes in the seventh area, a total number of the plurality of tubes in the third area is equal to a total number of the plurality of tubes in the sixth area, and a total number of the plurality of tubes in the fourth area is equal to a total number of the plurality of tubes in the fifth area.

* * * * *